United States Patent [19]

Quint et al.

[11] Patent Number: 4,833,329

[45] Date of Patent: May 23, 1989

[54] SYSTEM FOR GENERATING AND CONTAINERIZING RADIOISOTOPES

[75] Inventors: Randall H. Quint, Kirkwood; Richard F. Swenson, Fenton; David M. Wong, St. Louis County, all of Mo.

[73] Assignee: Mallinckrodt, Inc., St. Louis, Mo.

[21] Appl. No.: 123,586

[22] Filed: Nov. 20, 1987

[51] Int. Cl.[4] ..... G21H 5/00

[52] U.S. Cl. ..... 250/432 PD; 250/430; 141/305; 251/9; 137/573; 137/614.11

[58] Field of Search ..... 250/432 PD, 430; 141/305; 251/9; 137/573, 614.11

[56] References Cited

U.S. PATENT DOCUMENTS 3,655,981 4/1972 Montgomery et al. ..... 250/106 T
3,710,118 1/1973 Holgate et al. ..... 250/106 S
4,296,785 10/1981 Vitello et al. ..... 141/105
4,387,303 6/1983 Benjamins ..... 250/432 PD

*Primary Examiner*—Bruce C. Anderson
*Assistant Examiner*—Jack I. Berman
*Attorney, Agent, or Firm*—Senniger, Powers, Leavitt and Roedel

[57] ABSTRACT

A system for eluting a daughter radioisotope from a parent radioisotope and containerizing the resultant eluate in an evacuated container having a rubber stopper, providing for delivery of eluant from a reservoir through a tube to a generator containing the parent radioisotope, for venting of the reservoir to atmosphere via a tube, and for delivery of eluate from the generator via a tube to a tubular needle pierced through the stopper, with a cam-controlled hinged pinch plate for pinching the tubes closed.

20 Claims, 4 Drawing Sheets

SYSTEM FOR GENERATING AND CONTAINERIZING RADIOISOTOPES

BACKGROUND OF THE INVENTION

This invention relates to a system for generating and containerizing radioisotopes, and more particularly to apparatus for the generation and containerization under sterile conditions of radioactive isotope solutions such as are obtained as the eluate in a radioisotope generator system.

Reference may be made to the coassigned U.S. Pat. No. 3,655,981, issued Apr. 11, 1972, entitled Closed System Generation and Containerization of Radioisotopes for Eluting a Daughter Radioisotope from a Parent Radioisotope, the coassigned U.S. Pat. No. 3,710,118 issued Jan. 9, 1973, entitled Radioisotope Generator and the coassigned U.S. Pat. No. 4,296,785, issued Oct. 27, 1981, entitled System for Generating and Containerizing Radioisotopes, each disclosing a system for the preparation and packaging, under sterile conditions, of a solution of a daughter radioisotope, such as technetium 99M, generated from a parent radioisotope, such as molybdenum-99, wherein the daughter radioisotope is eluted from a parent radioisotope contained in a generator with an anion exchange medium or other medium, such as alumina, having a high adsorptive capacity for the parent but a low adsorptive capacity for the daughter, by washing with a suitable solvent or eluant such as a sterile, pyrogen-free isotonic saline solution. These three coassigned patents are incorporated herein by reference. The present invention involves improvements over the systems disclosed therein, in particular involving an improvement over the system disclosed in U.S. Pat. No. 4,296,785.

Reference may also be made to U.S. Pat. No. 4,387,303, issued June 7, 1983, entitled Radioisotope Generator for disclosure of another system for generating and containerizing radioisotope, particularly for its disclosure therein of pinching a tube.

SUMMARY OF THE INVENTION

Among the several objects of this invention may be noted the provision of a system for generating and containerizing radioisotopes of the type shown in U.S. Pat. No. 4,296,785 utilizing an eluant reservoir with a vent for atmospheric pressurization of the eluant therein, with improved valving for operating with less tendency toward leakage, and easier assembly; and the provision of such a system utilizing plastic tubes for venting the eluant reservoir, for flow of eluant from the reservoir to the generator of the system, and for flow of eluate from the generator to the needle, wherein valving is accomplished by pinching the tubes, and wherein the tubes are readily assembled in the system; and the provision of such a system wherein the pinching of the tubes is effected in a manner which tends to avoid displacement and damaging the tubes.

In general, a system of this invention is operable for eluting a daughter radioisotope from a parent radioisotope and for containerizing the resultant eluate in an evacuated container having a closure adapted to be pierced by a tubular needle. It comprises a generator containing a supply of the parent radioisotope having an inlet for an eluant for eluting the daughter radioisotope from the parent radioisotope and an outlet for the resultant eluate, a reservoir for holding a supply of the eluant having an outlet for delivery of eluant to the inlet of the generator and an air inlet for admission to the reservoir of air from the atmosphere to apply atmospheric air pressure to eluant in the reservoir, and a tubular needle for piercing the closure of an evacuated container. A first flexible tube is connected to the air inlet of the reservoir for venting it to atmosphere, a second flexible tube interconnects the outlet of the reservoir and the inlet of the generator, and a third flexible tube interconnects the outlet of the generator and the tubular needle, each of these tubes being resiliently compressible and thereby adapted to be pinched for closing it. Valve means is provided for pinching the tubes to close them and is operable on entry of the tubular needle through the closure of an evacuated container into the container to open the tubes for venting the reservoir to atmosphere via the first tube, for delivery of eluant from the reservoir to the generator via the second tube, and for delivery of eluate from the generator via the third tube to the needle and thence to the container. This valve means comprises a body having spaced side walls and being open at one edge of the walls, each side wall of the head having a slot therein extending down from said edge thereof. The first, second and third tubes are received in the slots in the side walls one on another with portions of the tubes extending from wall-to-wall. The body has a back-up for said portions of the tubes against which the tubes may be pinched for closing them. Means carried by the body is movable between a tube-pinching position wherein the tubes are pinched closed against said back-up and a retracted position for releasing the tubes to open them and operable on piercing of the closure of an evacuated container by the needle to open the tubes for the delivery of eluant into the container.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 4:
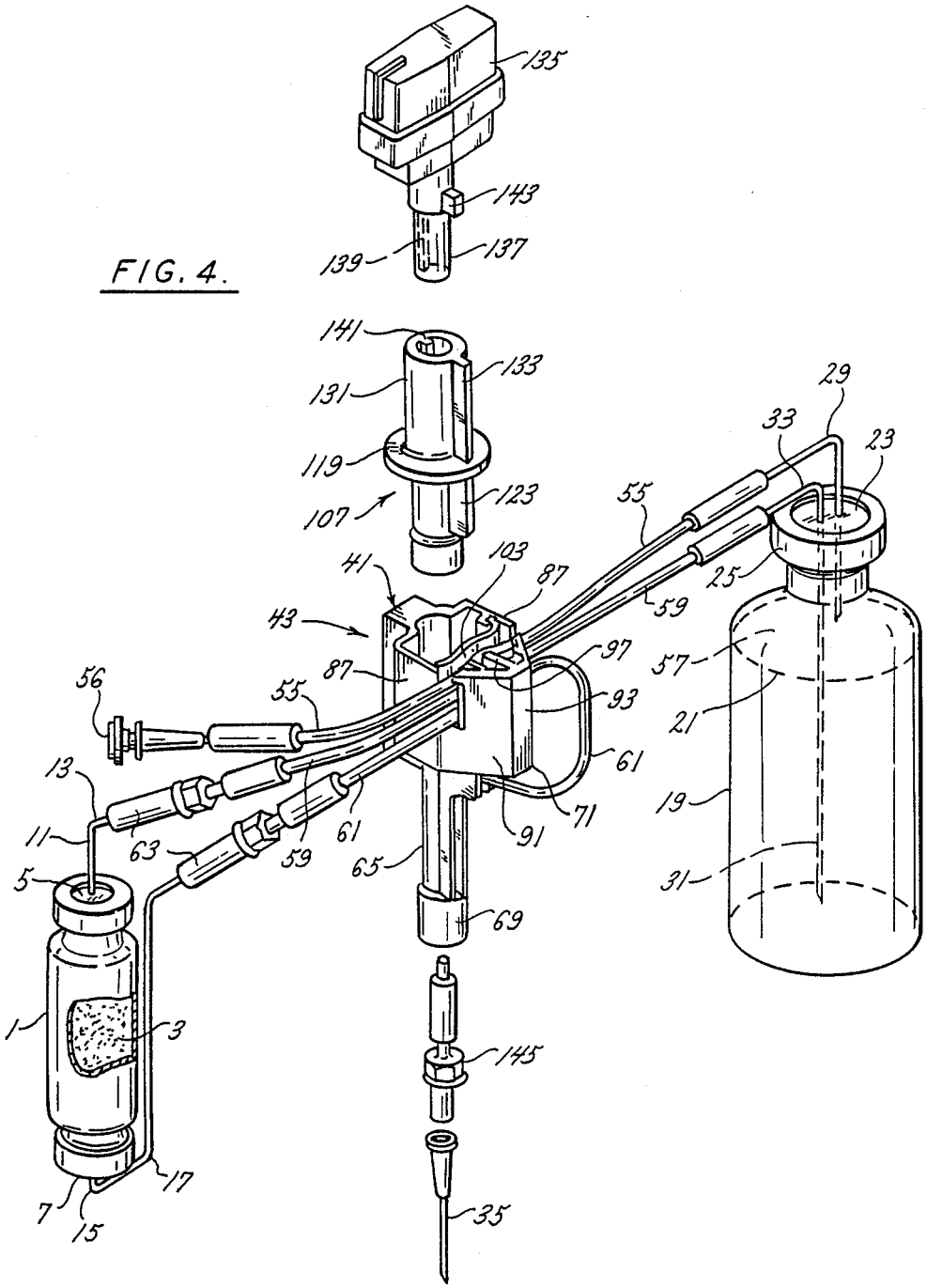
FIG. 4 is an exploded view of the valve means and the associated eluant reservoir and generator.

Referring to the drawings, first more particularly to FIG. 4, a system of this invention for generating and containerizing radioisotopes is shown to comprise a generator 1 containing a sterile pyrogen-free supply indicated at 3 of a parent radioisotope. As disclosed in the aforesaid U.S. Pat. No. 4,296,785, generally, this generator comprises an elongate cylindric glass tube having piercable closures indicated at 5 and 7 at its upper and lower ends (upper and lower as shown in FIG. 4) each constituted by a rubber stopper plugged in the respective end of the container. An aluminum crimp cap 9 is shown for each stopper with a central section of the cover removed. The parent radioisotope may be molybdenum-99, for example, adsorbed on an anion exchange medium, alumina or other medium (as in U.S. Pat. No. 3,655,981) for generating technetium-99M. The generator could be a tin/indium or germanium/gallium generator. Pierced through the rubber stopper at the upper end of the generator is the downturned end 11 of a relatively thin metal tube 13 constituting an eluant inlet for the generator. Pierced through the rubber stopper at the lower end of the generator is the upturned end 15 of a relatively thin metal tube 17 constituting an eluant outlet for the generator.

At 19 is shown a reservoir for holding a supply of eluant indicated at 21 (e.g. saline solution). Preferably, this is a glass bottle having a rubber stopper 23 in its mouth with an aluminum foil cover 25 for the stopper, shown in FIG. 4 with a central circular section of the cover removed. Pierced through the stopper 23 is the downturned end 27 of a relatively thin metal tube 29 constituting an air inlet for the reservoir or bottle, for admission of air to the bottle to apply atmospheric air pressure on the eluant 21 in the bottle. Also pierced through the stopper 23 is the downturned leg 31 of a thin metal tube 33 constituting an eluant outlet for the bottle. The downturned leg 31 of the tube 33 extends down in the bottle nearly to the bottle of the bottle for the delivery of eluant upwardly through the leg 31.

Figure 1:
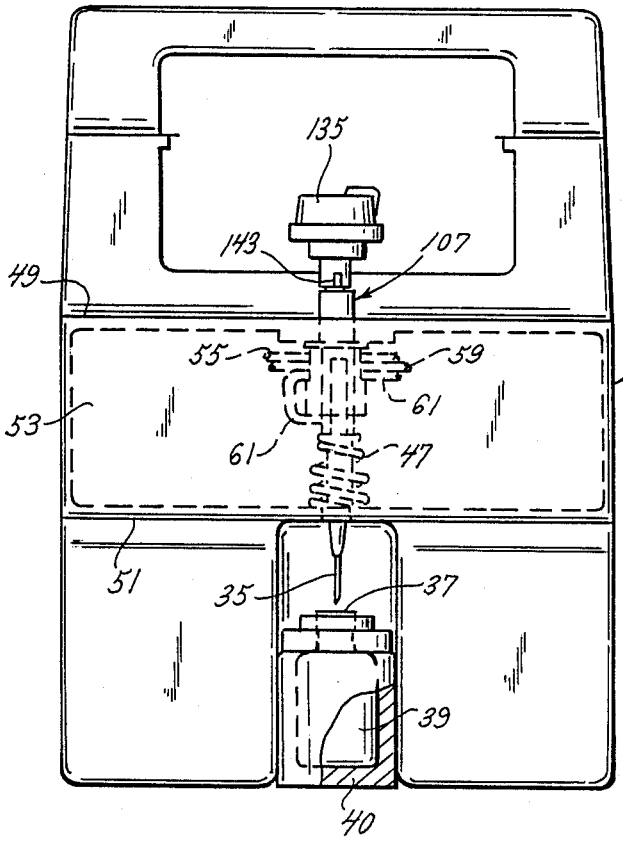
FIG. 1 is a view in front elevation of a case of a system of this invention for generating and containerizing radioisotopes.
Figure 2:
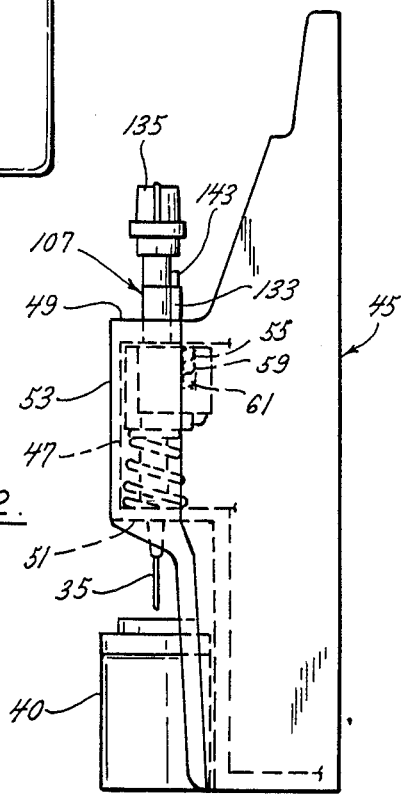
FIG. 2 is a view in side elevation of part of the case.

At 35 is indicated a tubular needle for piercing the rubber stopper 37 of a sealed sterile evacuated container or vial 39 (which may be placed in a lead shield as indicated at 40 in FIGS. 1 and 2). The tubular needle 35 extends down from the lower end of the valve body 41 of valve means of this invention which is designated in its entirety by the reference numeral 43. The valve body 41 is carried by a case indicated generally at 45 in FIGS. 1 and 2 corresponding generally to the case shown in U.S. Pat. No. 3,655,981, for movement downwardly from its raised retracted position of FIGS. 1 and 2 against the upward bias of a return spring 47 for causing the needle to pierce the rubber stopper or closure 37 of the vial 39, and for movement back upwardly to its raised retracted position by the spring. The case is shown as including an overhanging portion having top and bottom walls 49 and 51 and an outer wall 53 for mounting the body 41.

A first flexible tube 55, constituted of a length of plastic tubing, which is resiliently compressible and thereby adapted to be pinched for closing it, is suitably connected at one end to the air inlet tube 29 for the eluant bottle or reservoir 19 and is in communication at its other end with the atmosphere upstream from the reservoir via a bacteriological filter 56 for precluding entry of bacteria from the atmosphere to the system. This tube is adapted to be pinched to close it, as will appear, to block communication between the head space 57 in the eluant reservoir above the eluant therein and the atmosphere. When the tube is open, the head space 57 is in communication with the atmosphere for subjecting the eluant in the eluant reservoir to atmospheric pressure for flow of eluant from the reservoir via the eluant outlet tube 33.

A second flexible tube designated 59, also constituted by a length of resiliently compressible pinchable plastic tubing, is suitably interconnected between the eluant outlet tube 33 and the generator inlet tube 13. This tube 59 is adapted to be pinched closed, as will appear, to block communication between the eluant reservoir and the generator. When tube 59 is open, eluant may flow from the reservoir to the generator.

A third flexible tube designated 61, also constituted by a length of resiliently compressible pinchable plastic tubing, is interconnected between the generator outlet tube 17 and the tubular needle 35. This tube is adapted to be pinched closed, as will appear, to block communication between the generator and the tubular needle. When the tube 61 is open, eluate may flow from the generator to the needle.

Each of the tubes 55, 59, and 61 may be tubing made of plastic such as that sold under the trade name Silastic by Dow Corning Corp. of Midland, Michigan, of 0.156" outside diameter and 0.036" inside diameter. The tubes 13, 17, 29, 33 may be 19 gauge stainless steel tubes with beveled ends for piercing the respective stoppers and the connections to the tubes 13 and 17 may be by female luer fittings such as indicated at 63.

The valve means 43 is provided for pinching the three tubes 55, 59 and 61 to close them and is operable on entry of the tubular needle 35 through the closure 37 of an evacuated container of vial 39 to open the tubes for venting of the eluant reservoir 19 to atmosphere via tube 55, for delivery of eluant from the reservoir to the generator via the tube 59, and for delivery of eluate from the generator via tube 61 to the needle 35 and thence to the evacuated container or vial 39. The body 41 of the valve means may be molded in one piece of a suitable plastic, such as polypropylene, with a generally elongate stem 65 which extends vertically as used in the system and which thereby has an upper end at 67 and a lower end at 69, and a head 71 at the upper end of the stem.

The stem 65 is generally tubular so as to have an axial passage 73 for the tube 61. At its lower end 69 the stem is formed with an enlarged socket having an internal diameter somewhat larger than that of the passage 73, this socket having an internal annular groove 75. The passage 73 extends all the way down in the stem from its upper end to the socket, opening at its lower end into the socket. The stem is formed with an axial slot 77, flanges 79 being provided at opposite sides of the axial slot for stiffening the stem.

The head 71 has a bottom 81 and spaced side walls each generally designated 83 extending up from the bottom, the side walls 83 defining a recess 85 in the head which is open at the top of the head. The side walls have portions 87 extending parallel to one another from a transverse wall 89 of the head, which may be referred to as the back wall of the head, and forward portions which converge to a relatively narrow wall 93 which may be referred to as the front wall of the head. Each of the forward portions 91 of the side walls 83 of the head has a slot 95 therein extending down from the top edge of the respective wall adjacent the rearward ends of said forward portions generally in a vertical plane parallel to and spaced from the narrow front wall 93 of the head. The slots have a width slightly greater than the diameter of the first, second and third tubes 55, 59 and 61, which are received in these slots one on top of another, tube 61 being the first to be placed in the slots and hence the lowest of the three tubes, tube 59 being next and hence being the intermediate tube in the slots, and tube 55 being the last to be placed in the slots and hence being the uppermost of the three tubes. Portions of the tubes, so lodged in the slots, extend across the head across the rearward edge of a back-up member 97 extending rearward from the front wall 93 of the head, being bent to some extent around the rearward edge of this back-up member. The latter is constituted by a vertical rib formed integrally with the head extending rearward from the narrow front wall 93 of the head slightly beyond the plane of the forward edges of the slots 95. The stated portions of the tubes also extend over vertical ribs 99 extending between wall 89 of the head and forward portions 91 of the head side walls 83 and a central vertical rib 101.

The portions of the tubes 55, 59 and 61 which extend across the head 71 are adapted to be pinched or clamped closed against the rearward edge of the back-up member 97 by means comprising a pinch member 103 mounted for swinging movement on one of the side walls 83 of the head extending toward the other side wall above the ribs 99 and 101 and cam means 107 rotary in the head for swinging the pinch member into engagement with the portions of the tubes extending across the head to pinch or clamp them against the back-up member 97, and for releasing the pinch member to allow it to swing away from said portions of the tubes to allow them to open up. The pinch member is constituted by a flexible molded plastic plate member of generally rectagular shape having a flange 109 at one edge with a thickened bead 111 at the edge of the flange. The pinch plate 101 is mounted at said one side wall of the head by forming of that side wall with a vertical groove 113 on the inside and a flange 115 extending inwardly from that side wall at the rear of the groove with a lip 117 at the inner edge of the flange extending forward over the groove. The pinch plate is assembled with the head by sliding the bead 111 down into the recess defined by the groove 113, the flange 115 and the lip 117. The plate is adapted to flex adjacent the flange for the swinging of the plate generally on what is in effect an integral hinge adjacent its end with the bead 111.

The rotary cam means 107 comprises a molded plastic (e.g. polypropylene) member formed to have a circular disk constituting a cap 119 for engagement with the top of the head 71, a cam shaft 121 extending down from the disk with a lug 123 extending radially outwardly from this shaft constituting the cam proper, the outer edge of the lug being rounded. The lug 123 extends down from the disk or cap 119 toward but terminates short of the lower end of the shaft 121. The latter is made tubular and is formed on its exterior with an annular snap ring formation or rib 125 located below the lower end of the lug 115. The lower end portion of the shaft, below the lower end of the lug, is rotatably fitted in a generally cylindric bearing 127 formed in the head, this bearing having an annular groove 129 in which the annular snap ring formation or rib 125 on the shaft is snap fitted. A hub 131 extends up from the disk 119 coaxial with the shaft 121, this hub being tubular as appears in FIG. 4 and having an axial external key 133 extending throughout its length. A knob or handle 135 has a stem 137 fitted in the hub 131, the stem 137 having a keyway 139 which interfits with a key 141 in the hub for keying the knob to the hub. Stem 137 also has a stop 143 engageable with the upper end of the hub.

With the parts 41 and 107 disassembled, the upper end of the head 43 is open for insertion of the plate 103 in the head, also for insertion of the tubes 61, 59 and 55 (in that order) in the slots 95 in the side walls 83 of the head. The rotary member 107 may then be snap-fitted into assembly with the head. This makes for easy assembly. With member 107 so assembled with the head, the pinch plate 103 and the three tubes are held in place by the disk or cap 119 of member 107.

The eluate tube 61 is connected at one end to the eluate outlet tube 17 for the generator 1. It extends in a loop from the head 71 of the valve body 41 and through the slot 77 in the stem into the passage 73 in the stem 65 and down in the passage 73 to a fitting 145, e.g. a luer fitting, accommodated in the socket 69 at the lower end of the stem to which the needle 35 is removably attached. The fitting 145 has an annular rib 147 snapped into the groove 75.

Figure 3:
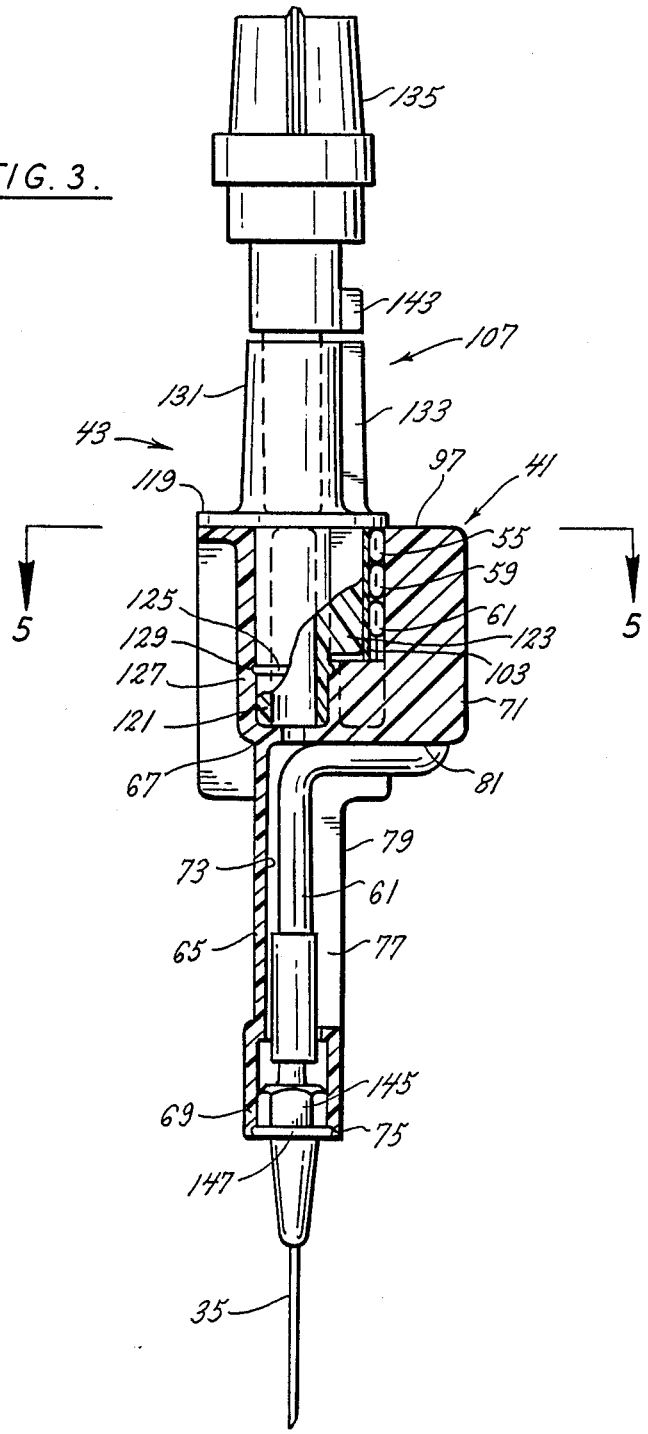
FIG. 3 is a view partly in side elevation and partly in vertical section of valve means of the system of this invention showing the tubes of the system pinched closed.
Figure 6:
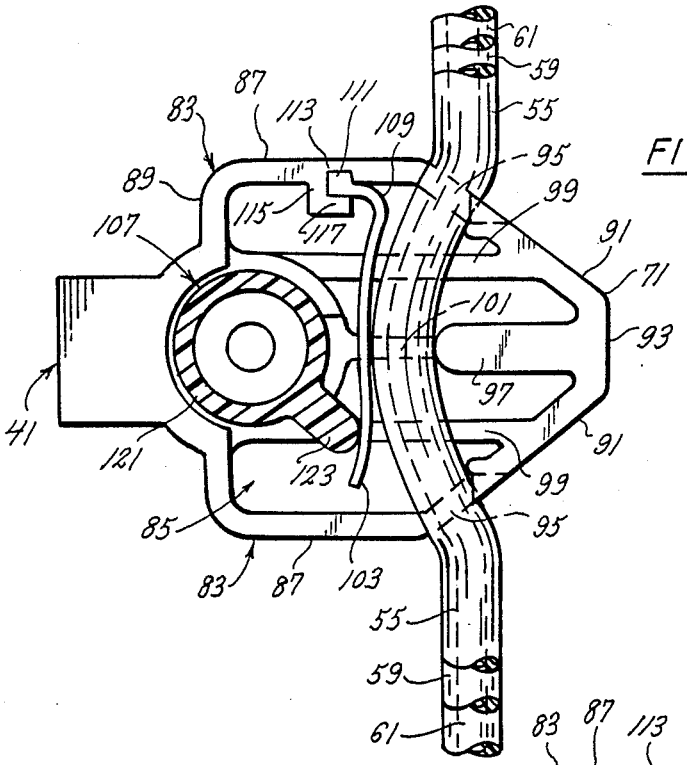
FIG. 6 is a view similar to FIG. 5 showing the tubes open.
Figure 5:
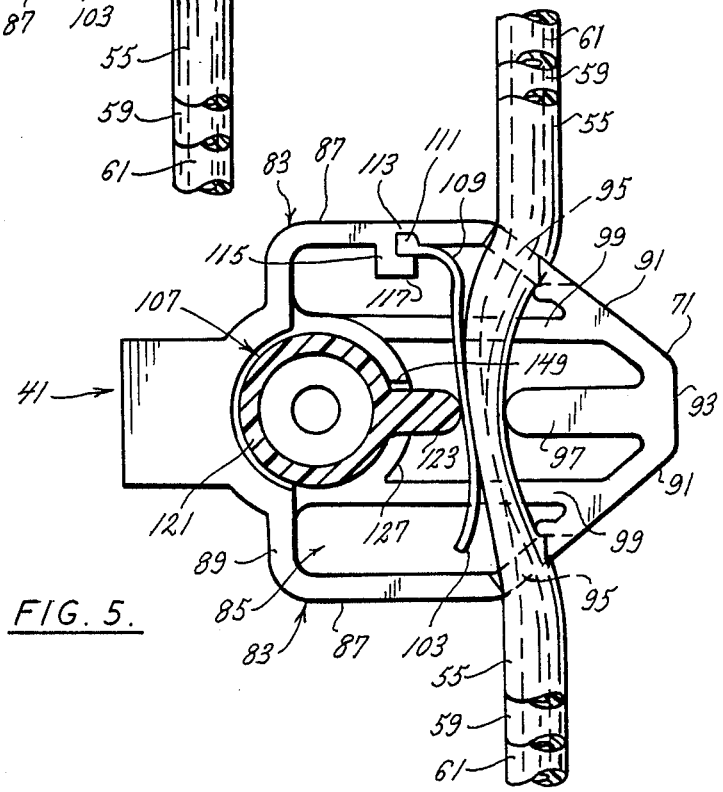
FIG. 5 is an enlarged section on line 5—5 of FIG. 3.

The cam member 107 normally occupies the tube-pinching position in which it is illustrated in FIG. 5 herein the cam lug 123 is in line with the back-up rib 97 and holds the pinch plate 103 against the tubes 55, 59 and 61 to pinch the tubes closed (see also FIG. 3). This tubepinching position of the cam member is generally determined by engagement of the lug 123 with the edge 149 of an upwardly extending portion of the bearing 127 in the head 71. The valve body 41 with the needle 35 extending down from its lower end, with the tubes 55, 59 and 61 in the slots 95, with the cam member 107 in place in the head 71 and in its tube-pinching position, and with knob 135 on the cam member, is movable downwardly against the bias of the spring 47 to drive the needle through the rubber stopper 37 of an evauated vial 39. The knob is then turned to turn the cam member to its tube-release position of FIG. 6 for opening the tubes for the flow of eluant from the bottle 19 via tube 59 to the generator 1 and for flow of eluate from the generator 1 via tube 61 to the needle 35 and thence into the vial. On delivery of the requisite amount of eluate into the vial, the knob is turned back to return the cam member 107 to its FIG. 5 tube-pinching position to cut off flow, and the valve body (with the needle and tubes) is released for return upward to its raised retracted position of FIGS. 1 and 2 awaiting filling of the next vial. The pinching of the tubes by the hinged pinch plate 103 is such as to avoid displacement ("walking") and stretching of the tubes, and also to avoid abrasion of the tubes.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A system for eluting a daughter radioisotope from a parent radioisotope and for containerizing the resultant eluate in an evacuated container having a closure adapted to be pierced by a tubular needle, said system comprising:

a generator containing a supply of the parent radioisotope, said generator having an inlet for an eluant for eluting the daughter radioisotope from the parent radioisotope and an outlet for the resultant eluate;

a reservoir for holding a supply of the eluant, said reservoir having an outlet for delivery of eluant to the inlet of the generator and an air inlet for admission to the reservoir of air from the atmosphere to apply atmospheric air pressure to eluant in the reservoir;

a tubular needle for piercing the closure of the evacuated container;

a first flexible tube connected to the air inlet of the reservoir and in communication with the atmosphere upstream from the reservoir;

a second flexible tube interconnecting the outlet of the reservoir and the inlet of the generator;

a third flexible tube interconnecting the outlet of the generator and the tubular needle;

each of said tubes being resiliently compressible and thereby adapted to be pinched for closing it;

and valve means for pinching the tubes to close them and operable on entry of the tubular needle through the closure of an evacuated container into the container to open the tubes for venting the reservoir to atmosphere via the first tube, for delivery of eluant from the reservoir to the generator via the second tube, and for delivery of eluate from the generator via the third tube to the needle and thence to the container;

wherein said valve means comprises:

a body having spaced side walls and being open at one edge of said walls;

each side wall having a slot therein extending from said edge thereof;

the first, second and third tubes being received in the slots in the side walls one on another with portions of the tubes extending from wall-to-wall;

the body having a back-up for said portions of the tubes against which the tubes may be pinched for closing them; and means carried by the body movable between a tube-pinching position wherein the tubes are pinched closed against said back-up and a retracted position for releasing the tubes to open them and operable on piercing of the closure of an evacuated container by the needle to open the tubes for the delivery of eluant into the container.

2. A system as set forth in claim 1 wherein said tube-pinching means comprises a pinch member mounted on one of the side walls extending toward the other side wall and swingable toward and away from the back-up, and means movably associated with the body for swinging the pinch member into pressure engagement with said portions of the tubes to pinch them against said back-up and for releasing the pinch member to allow it to swing away from said portion of the tubes to allow them to open up.

3. A system as set forth in claim 2 wherein said means for swinging the pinch member comprises a cam means rotary with respect to the body.

4. A system as set forth in claim 2 wherein said pinch member comprises a plate having an edge portion received in a groove in said one side wall of the head and an integral hinge adjacent said edge portion.

5. A system as set forth in claim 4 wherein said means for swinging the plate comprises a cam means rotary with respect to the body.

6. A system as set forth in claim 3 wherein the cam means comprises a shaft rotary at one end in a bearing on the body, said shaft having a cam thereon which engages the pinch member.

7. A system as set forth in claim 6 wherein the shaft has means thereon overlying the open ends of the slots for retaining the tubes in the slots.

8. A system as set forth in claim 7 wherein the shaft and bearing have snap-fit means for holding the shaft in the bearing.

9. A system for eluting a daughter radioisotope from a parent radioisotope and for containerizing the resultant eluate in an evacuated container having a closure adapted to be pierced by a tubular needle, said system comprising:

a generator containing a supply of the parent radioisotope, said generator having an inlet for an eluant for eluting the daughter radioisotope from the parent radioisotope and an outlet for the resultant eluate;

a reservoir for holding a supply of the eluant, said reservoir having an outlet for delivery of eluant to the inlet of the generator and an air inlet for admission to the reservoir of air from the atmosphere to apply atmospheric air pressure to eluant in the reservoir;

a tubular needle for piercing the closure of an evacuated container;

a first flexible tube connected to the air inlet of the reservoir and in communication with the atmosphere upstream from the reservoir;

a second flexible tube interconnecting the outlet of the reservoir and the inlet of the generator;

a third flexible tube interconnecting the outlet of the generator and the tubular needle;

each of said tubes being resiliently compressible and thereby adapted to be pinched for closing it;

and valve means for pinching the tubes to close them and operable on entry of the tubular needle through the closure of an evacuated container into the container to open the tubes for venting the reservoir to atmosphere via the first tube, for delivery of eluant from the reservoir to the generator via the second tube, and for delivery of eluate from the generator via the third tube to the needle and thence to the container;

wherein said valve means comprises:

a body comprising a stem having an uper end and a lower end, the needle extending down from the lower end of the stem;

a head at the upper end of the stem having a bottom and spaced side walls extending up from the bottom;

the body being movable down from a raised retracted position for causing the needle to pierce the closure of an evacuated container placed below the lower end of the needle;

each side wall of the head having a slot therein extending down from the top of the wall;

the first, second and third tubes being received in the slots in the side walls one on another with portions of the tubes extending across the head;

the head having a back-up for the portions of the tubes extending across the head against which the tubes may be pinched for closing them; and means in the head movable between a tube-pinching position wherein the tubes are pinched closed against said back-up and a retracted position for releasing the tubes to open them and operable on downward movement of the stem to drive the needle through the closure of an evacuated container to open the tubes for the delivery of eluant into the container.

10. A system as set forth in claim 9 wherein said tube-pinching means comprises a pinch member mounted at one of the side walls of the head extending toward the other side wall and swingable toward and away from the back-up, and means movable in the head for swinging the pinch member into pressure engagement with the portions of the tubes extending across the head to pinch them against said back-up and for releasing the pinch member to allow it to swing away from said portion of the tubes to allow them to open up.

11. A system as set forth in claim 10 wherein said means for swinging the pinch member comprises a cam means rotary in the head and a knob above the head for rotating the cam means.

12. A system as set forth in claim 10 wherein said pinch member comprises a plate having an edge portion received in a groove in said one side wall of the head and an integral hinge adjacent said edge portion.

13. A system as set forth in claim 12 wherein said means for swinging the plate comprises a cam means rotary in the head and a knob above the head for rotating the cam means.

14. A system as set forth in claim 9 wherein said stem is tubular and has a slot extending lengthwise thereof terminating short of its lower end, the said third tube extending from the head through said slot in the stem to the interior of the stem and connected therein for communication with the upper end of the tubular needle.

15. A system as set forth in claim 14 wherein said tube-pinching means comprises a pinch member mounted at one of the side walls of the head extending toward the other side wall and swingable toward and away from the back-up, and means movable in the head for swinging the pinch member into pressure engagement with the portions of the tubes extending across the head to pinch them against said back-up and for releasing the pinch member to allow it to swing away from said portion of the tubes to allow them to open up.

16. A system as set forth in claim 15 wherein said means for swinging the pinch member comprises a cam means rotary in the head and a knob above the head for rotating the cam means.

17. A system as set forth in claim 15 wherein said pinch member comprises a plate having an edge portion received in a groove in said one side wall of the head and an integral hinge adjacent said edge portion.

18. A system as set forth in claim 17 wherein said means for swinging the plate comprises a cam means rotary in the head and a knob above the head for rotating the cam means.

19. A system as set forth in claim 11 wherein the cam means comprises a shaft extending down in the head rotary at its lower end in a bearing in the head, said shaft having a cam thereon above the bearing engageable with the pinch member.

20. A system as set forth in claim 19 wherein the shaft has means thereon overlying the upper ends of the slots for retaining the tubes in the slots, and wherein the shaft and bearing have snap-fit means for holding the shaft in the bearing.

* * * * *